US005533210A

United States Patent [19]

Maderek et al.

[11] Patent Number: 5,533,210

[45] Date of Patent: Jul. 9, 1996

[54] COMPLETELY REYCLABLE JACKET MADE OF SYNTHETIC POLYMER MATERIAL

[75] Inventors: Eugeniusz Maderek; Friedhelm Brandau, both of Wuppertal, Germany

[73] Assignee: Akzo Nobel N.V., Velperweg, Netherlands

[21] Appl. No.: 272,576

[22] Filed: Jul. 11, 1994

[30] Foreign Application Priority Data

Feb. 4, 1994 [DE] Germany ..... 94 01 905.3 U

[51] Int. Cl.[6] ..... A41D 1/02

[52] U.S. Cl. ..... 2/93; 2/108

[58] Field of Search ..... 2/69, 82, 79, 85, 2/87, 88, 93, 106, 108, 901, 904, 243.1

[56] References Cited

U.S. PATENT DOCUMENTS

| | | | |
|---|---|---|---|
| 2,620,477 | 12/1952 | Ackerman, Jr. et al. | 2/87 |
| 2,656,541 | 10/1953 | Beaver et al. | 2/87 |
| 2,756,431 | 7/1956 | DeLuca, Jr. et al. | 2/87 |
| 3,665,518 | 5/1972 | Leadford | 2/87 |
| 4,141,082 | 2/1979 | Nakazawa et al. | 2/93 |
| 4,164,792 | 8/1979 | Ito | 2/108 |
| 4,651,353 | 3/1987 | Walden | 2/114 |
| 4,783,856 | 11/1988 | Bouwens et al. | 2/87 |
| 5,082,721 | 1/1992 | Smith, Jr. et al. | 2/81 |
| 5,225,130 | 7/1993 | Deiringer . | |
| 5,399,423 | 3/1995 | McCullough et al. | 2/2 |
| 5,409,761 | 4/1995 | Langley | 2/901 |

FOREIGN PATENT DOCUMENTS

| | | | |
|---|---|---|---|
| 0599101 | 6/1994 | European Pat. Off. . | |
| 2153166 | 5/1972 | Germany . | |
| 2641215 | 9/1976 | Germany | 2/79 |
| 87066874 | 10/1987 | Germany . | |
| 4034459 | 5/1992 | Germany . | |
| 4140580 | 6/1993 | Germany . | |
| 92153283 | 6/1993 | Germany . | |

OTHER PUBLICATIONS

Bartholome, Ernst et al., Ullmann's Encylopedia of Industrial Chemistry, Verlag Chemie, Weinheim, 4th Ed., vol. 11, pp. 294–295, 305, 311–312.

Sport Premier Magazine, May 1993, pp. 22.

*Primary Examiner*—Amy B. Vanatta

*Attorney, Agent, or Firm*—Oliff & Berridge

[57] ABSTRACT

Completely recyclable jacket made up of components including outer material, lining, pocket linings, buttons, fasteners, seams, sewing thread and optional additional ordinary accessories, where the components are made of sorted thermoplastic synthetic polymers which are mixable homogeneously with one another in the molten state.

18 Claims, 1 Drawing Sheet

COMPLETELY REYCLABLE JACKET MADE OF SYNTHETIC POLYMER MATERIAL

FIELD OF THE INVENTION

The invention relates to a completely recyclable jacket made of synthetic polymer material.

BACKGROUND

Considerable attention has been devoted in recent years to recycling waste because of the increasing threat of environmental problems. Thus, for example, glasses and bottles, metal cans, packing materials, and many other materials are collected separately and sent away for recycling. Since legislation is also growing more strict, the pressure to recycle is increasing steadily. In addition, because take-back guarantees for used articles are either prescribed by law or are at least a good selling point, the trade and the manufacturers are coming under increased pressure to recycle their products.

This also applies to the textile industry. Frequently, used textiles are collected, e.g. at used clothing depots, and then broken up, particularly by tearing, then sent to reprocessing. With such a process, the material of which the used textiles are made is not critical. The problem of final disposal of the textile fabric or reprocessing into a completely new textile is however not solved by this.

Since a textile, particularly a jacket, is a composite article in whose manufacture lining, etc. and a number of accessories are used, which can consist of very different kinds of materials, it has thus far always been necessary to break down the textile into the individual components then send these components separately to reprocessing. This procedure is cumbersome and labor-intensive; also there is the risk that because of careless work or for some other reason, separation into the individual components is incomplete and the material to be reprocessed is nonuniform, which leads to corresponding difficulties. Frequently, the individual components used to make the jacket are so firmly attached to each other that clean separation of the components into the various materials is practically impossible.

SUMMARY OF THE INVENTION

Therefore there is a need for a fully recyclable textile that does not suffer from the disadvantages listed above and which can be sent in its totality to reprocessing without separation into the individual components being necessary.

Hence a goal of the invention is to produce a jacket which does not have to be broken down into various components for reprocessing and whose reprocessing leads to a uniform reprocessable raw material from which useful products can be made.

Another goal of the invention is to produce such a jacket which has good wearing comfort, and which may have good functional properties such as protection from cold, protection from heat, and barrier properties against bacteria or viruses for example.

This problem is solved by a fully recyclable jacket made of synthetic polymers composed of outer material, lining, pocket linings, buttons, and/or zip fasteners, seams, and the like and possibly additional ordinary accessories, wherein the outer material, lining, pocket linings, buttons, and/or zip fasteners, sewing thread, and the like as well as the accessories are made of sorted thermoplastic synthetic polymers which are mixable homogeneously with one another in the molten state. Such jackets can also advantageously include a watertight, water-vapor-permeable laminate. The jacket can also have other functional layers such as nonwoven filler materials.

The reprocessing of such jackets is described in U.S. patent application Ser. No. 08/272,731 filed simultaneously herewith (attorney docket no. WPB 29351), the entire contents of which are hereby incorporated by reference.

DETAILED DESCRIPTION OF PREFERRED EMBODIMENTS

Figure 1:
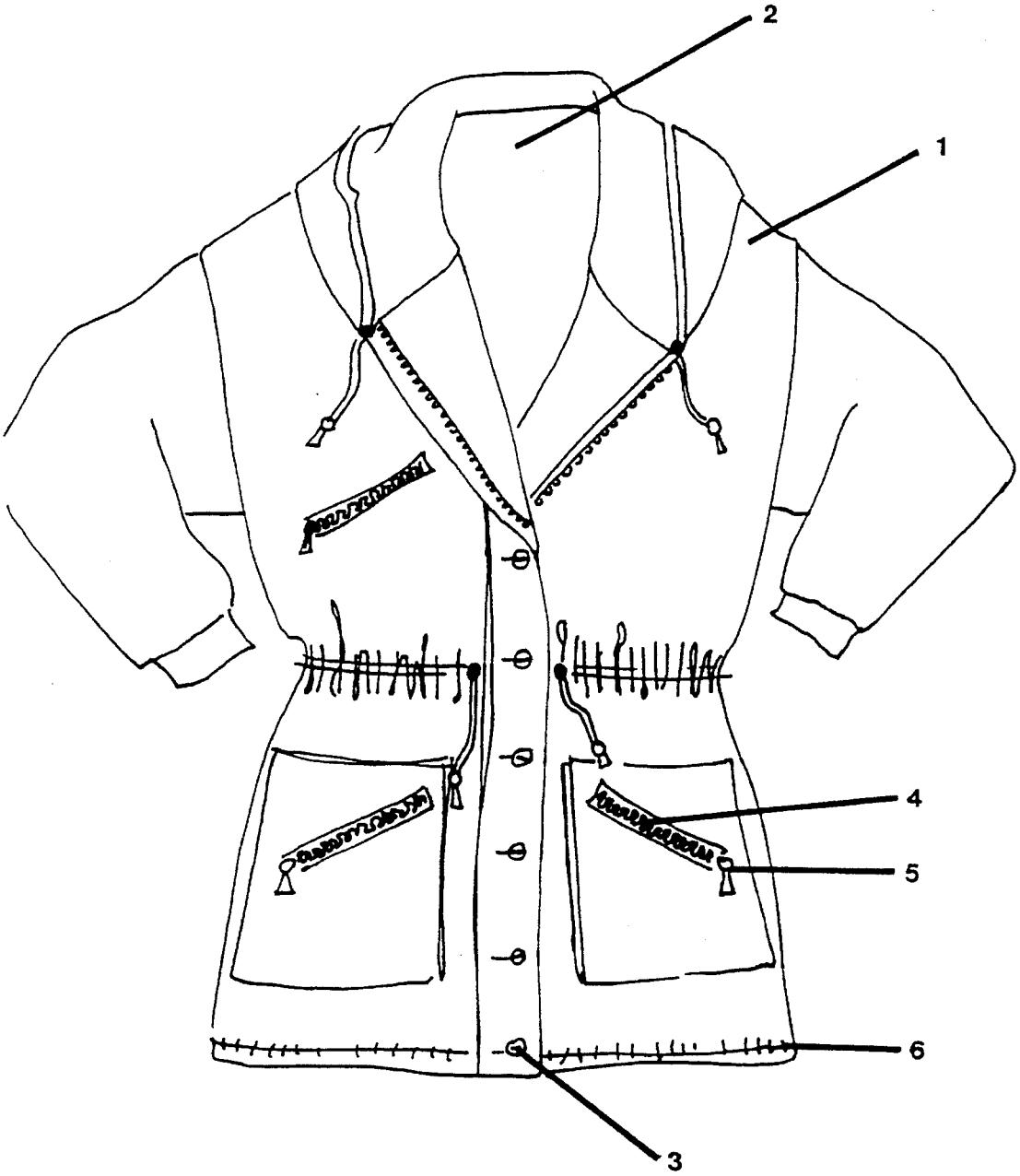
FIG. 1 illustrates a jacket according to the present invention.

Preferably the sorted thermoplastic synthetic polymers comprise or consist of polyester.

In another embodiment of the invention, the mixture comprises or consists of sorted thermoplastic synthetic polymers made of polyamides.

"Sorted" as defined by the invention means that the polymers consist essentially of a uniform material; for example all the components are polyester, for example polyethylene terephthalate, polybutylene terephthalate, and a copolyether ester, or are polyamides such as polyamide 6 and polyamide 6,6 or polyamide ether.

"Homogeneously mixable with each other in the molten state" means that the sorted polymers are mutually compatible in the molten state, i.e. they form a single-phase liquid mixture. Thus for example polyamide 6 and polyamide 6,6 are readily mixable with each other in the molten state, while different polymers that have not been sorted form a two-phase liquid mixture in the molten state.

The jacket can have shoulder pads made of polyester, and heat-set material made of polyester on the collar. The jacket can also contain a drawstring and drawstring stop. The buttons can be made in their entirety or partially as snap fasteners. The buttons are sewn on with polyester thread.

The watertight, water vapor permeable laminate of polyester materials preferably comprises a textile support of polyethylene terephthalate, a water-vapor-permeable watertight membrane of a copolyether ester as well as an adhesive of modified polyester. In polyamide jackets, when a laminate is used, this comprises a watertight, water-vapor-permeable membrane based on a polyamide ether, such as is sold for example by the French company Atochem under the name Bepax (TM).

The outer material comprises for example polyethylene terephthalate and the buttons polybutylene terephthalate.

The buttons can be made as snap fasteners or as regular sew-on buttons. They are preferably made of recycled polymer.

The jacket according to the invention has high wearing comfort. It is simple and economical to manufacture in the usual way. In re-processing, separation into the individual components is unnecessary. Instead, it can be sent to reprocessing whole and converted into a useful polymer raw material for example by melting and conversion into a granulate.

Jackets according to the invention which have nonporous bacteria- and virus-proof membranes are very advantageous. These are suitable primarily for use in hospitals and doctors' offices where protection against infection is important.

The figure shows one embodiment of a jacket according to the invention which has among other features an outer material (1), a lining (2), buttons (3), a zip fastener (4), and a zip fastener slide (5) as well as seams (6), pocket lining, water-vapor-permeable watertight laminate (not shown), as well as other accessories.

The framework of the invention of course also includes recyclable jackets which are mass-produced, i.e. which contain small quantities of dyes, water-repellants, sizes, polyurethane seam-sealing strips, adhesives, and the like, i.e. auxiliary materials which do not belong to the sorted polymers as defined above. These materials are present in a quantity which is not harmful as related to the total quantity of polymer material, and in general is less than 5 wt. % and preferably less than 1 wt. %.

What is claimed is:

1. Completely recyclable jacket, said completely recyclable jacket being a textile jacket consisting essentially of components consisting essentially of sorted thermoplastic synthetic polymers which are mixable homogeneously with one another in a molten state.

2. Jacket according to claim 1, wherein said components are selected from the group consisting of outer material, linings, pocket linings, buttons, fasteners, seams and sewing thread.

3. Jacket according to claim 2, wherein said buttons are comprised wholly or partially of recycled polymer.

4. Jacket according to claim 1, wherein said jacket comprises a water-vapor-permeable, watertight laminate.

5. Jacket according to claim 4, wherein said laminate comprises a textile support made of polyethylene terephthalate, a water-vapor-permeable watertight membrane made of a copolyether ester, and an adhesive made of modified polyester.

6. Jacket according to claim 1, wherein said synthetic polymers comprise polyesters.

7. Jacket according to claim 6, wherein said jacket comprises polyester shoulder pads.

8. Jacket according to claim 7, wherein said shoulder pads comprise wholly or partially recycled polyester.

9. Jacket according to claim 6, wherein said jacket comprises heat-set polyester material at the collar.

10. Jacket according to claim 6, wherein said buttons comprise polybutylene terephthalate.

11. Jacket according to claim 1, wherein said synthetic polymers comprise polyamides.

12. Jacket according to claim 1, wherein said jacket has a drawstring.

13. Jacket according to claim 12, wherein said jacket has a drawstring stop.

14. Jacket according to claim 1, wherein said synthetic polymer is comprised wholly or partially of recycled material.

15. Jacket according to claim 1, wherein said jacket comprises a nonporous bacteria- and virus-proof membrane.

16. Jacket according to claim 1, wherein said jacket contains up to 5 weight percent auxiliary material.

17. Jacket according to claim 16, wherein said jacket contains up to 1 weight percent auxiliary material.

18. Completely recyclable jacket, said completely recyclable jacket being a textile jacket having a nonwoven filler layer and components, said nonwoven filler layer and components consisting essentially of sorted thermoplastic synthetic polymers which are mixable homogeneously with one another in a molten state.

* * * * *

UNITED STATES PATENT AND TRADEMARK OFFICE

CERTIFICATE OF CORRECTION

PATENT NO. : 5,533,210

DATED : July 9, 1996

INVENTOR(S) : Eugeniusz MADEREK and Freidhelm BRANDAU

It is certified that error appears in the above-identified patent and that said Letters Patent is hereby corrected as shown below:

On the title page: Item [54] change "REYCLABLE" to --RECYCLABLE--;

On the title page: column 2, change "87066874" to --8706687--;

On the title page: column 2, change "92153283" to --9215328--.

At column 1, line 1, change "REYCLABLE" to --RECYCLABLE--.

At claim 10, line 1, change "6" to --2--.

Signed and Sealed this

Fifteenth Day of October, 1996

*Attest:*

*Attesting Officer*

Bruce Lehman

BRUCE LEHMAN

*Commissioner of Patents and Trademarks*